US009562315B2

(12) United States Patent
Al-Harthi

(10) Patent No.: US 9,562,315 B2
(45) Date of Patent: Feb. 7, 2017

(54) MACHINE FOR REMOVING WRINKLES FROM FABRIC

(71) Applicant: UMM AL-QURA UNIVERSITY, Makkah (SA)

(72) Inventor: Rakan Al-Harthi, Makkah (SA)

(73) Assignee: UMM AL-QURA UNIVERSITY, Makkah (SA)

( * ) Notice: Subject to any disclaimer, the term of this patent is extended or adjusted under 35 U.S.C. 154(b) by 0 days.

(21) Appl. No.: 14/680,011

(22) Filed: Apr. 6, 2015

(65) Prior Publication Data

US 2016/0289887 A1 Oct. 6, 2016

(51) Int. Cl.

| | |
|---|---|
| ***D06F 63/00*** | (2006.01) |
| ***D06F 67/02*** | (2006.01) |
| ***D06F 71/36*** | (2006.01) |
| ***D06F 83/00*** | (2006.01) |
| ***D06F 58/10*** | (2006.01) |

(52) U.S. Cl.

CPC ..... *D06F 63/00* (2013.01); *D06F 58/10* (2013.01); *D06F 67/02* (2013.01); *D06F 71/36* (2013.01); *D06F 83/00* (2013.01)

(58) Field of Classification Search

CPC ..... D06F 69/00; D06F 65/00; D06F 65/02; D06F 71/16; D06F 71/34; D06F 71/36; D06F 71/40; D06F 63/00; D06F 67/00; D06F 83/00; D06F 67/02; D06F 58/10; A47G 25/78

See application file for complete search history.

(56) References Cited

U.S. PATENT DOCUMENTS

| | | | | |
|---|---|---|---|---|
| 1,053,572 | A * | 2/1913 | Chatfield | D06F 75/30 126/410 |
| 1,473,662 | A * | 11/1923 | Banks | A47G 25/78 38/73 |
| 2,262,222 | A * | 11/1941 | Castricone | D06F 67/005 312/21 |
| 2,451,102 | A * | 10/1948 | Litke | D06F 75/30 219/230 |
| 2,522,247 | A * | 9/1950 | Asta | D06F 75/30 38/100 |
| 2,873,830 | A | 2/1959 | Wilt | |
| 3,287,542 | A * | 11/1966 | Weitzner | A47G 25/72 219/244 |

(Continued)

FOREIGN PATENT DOCUMENTS

CN 201222985 Y 4/2009

OTHER PUBLICATIONS

*How to Roll Clothes* http://www.wikihow.com/Roll-Clothes (Last Accessed on Jul. 1, 2012) 4 Pages.

*Primary Examiner* — Ismael Izaguirre
(74) *Attorney, Agent, or Firm* — Richard C. Litman

(57) ABSTRACT

The machine for removing wrinkles from fabric includes a tubular member, a rod positioned inside the tubular member to support the tubular member, and a heating element positioned in communicating relation with the tubular member. The machine can include a case having a fastener, such as mating hook and loop fasteners. The machine can also include at least one temperature sensor, a timer, and at least one fragrance canister including a fragrance dispenser and a corresponding tube. The fragrance dispenser is configured for dispensing a fragrance onto a piece of fabric.

15 Claims, 5 Drawing Sheets

(56) References Cited

U.S. PATENT DOCUMENTS

| | | | | | |
|---|---|---|---|---|---|
| 3,398,474 | A | * | 8/1968 | Weitzner | A47G 25/72<br>219/244 |
| 3,665,624 | A | * | 5/1972 | Briddell | A47G 25/72<br>38/71 |
| 5,526,829 | A | * | 6/1996 | Smith | A45D 1/02<br>132/229 |
| 2005/0217152 | A1 | * | 10/2005 | Pessayre | D06F 75/22<br>38/77.8 |
| 2006/0042114 | A1 | | 3/2006 | Robson et al. | |
| 2007/0261975 | A1 | | 11/2007 | Rabinoff | |
| 2010/0252513 | A1 | | 10/2010 | Tutuvanu | |

* cited by examiner

MACHINE FOR REMOVING WRINKLES FROM FABRIC

BACKGROUND OF THE INVENTION

1. Field of the Invention

The present invention generally relates to fabric, and more particularly, to a machine for removing wrinkles from fabric.

2. Description of the Related Art

As many who travel are well aware, it is very difficult to pack clothes in a suitcase in such a way that prevents clothes from being wrinkled. In order to compensate for this inconvenience, people who travel typically pack irons, steamers, or other suitable devices to eliminate or reduce the amount of wrinkles in clothing. Not only is it inconvenient to have to travel with irons and steamers due to the additional space they consume, but traveling with such additional equipment can also result in additional expenses in terms of overweight baggage fees, for example. Another option to dealing with this inconvenience is that travelers often rely on the laundry or valet services provided by their hotels. Relying on the laundry services provided by hotels can be expensive and inconvenient, since many require at least twenty-four hours to iron a hotel guest's clothes or charge a premium to have it done sooner. Further, even packing clothing in one's closet or dresser drawers can result in wrinkled clothing, causing people to have to iron or steam their clothing for a second time after it has already been washed, ironed/steamed, and stored.

Thus, a machine for removing wrinkles from fabric solving the aforementioned problems is desired.

SUMMARY OF THE INVENTION

The machine for removing wrinkles from fabric includes a tubular member, a rod positioned inside the tubular member to support the tubular member, and a heating element positioned in communicating relation with the tubular member. The machine can include a case having a locking mechanism, such as a buckle. The machine can also include at least one temperature sensor, a timer, and at least one fragrance dispenser and a corresponding tube. The fragrance dispenser is configured for dispensing a fragrance onto a piece of fabric.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
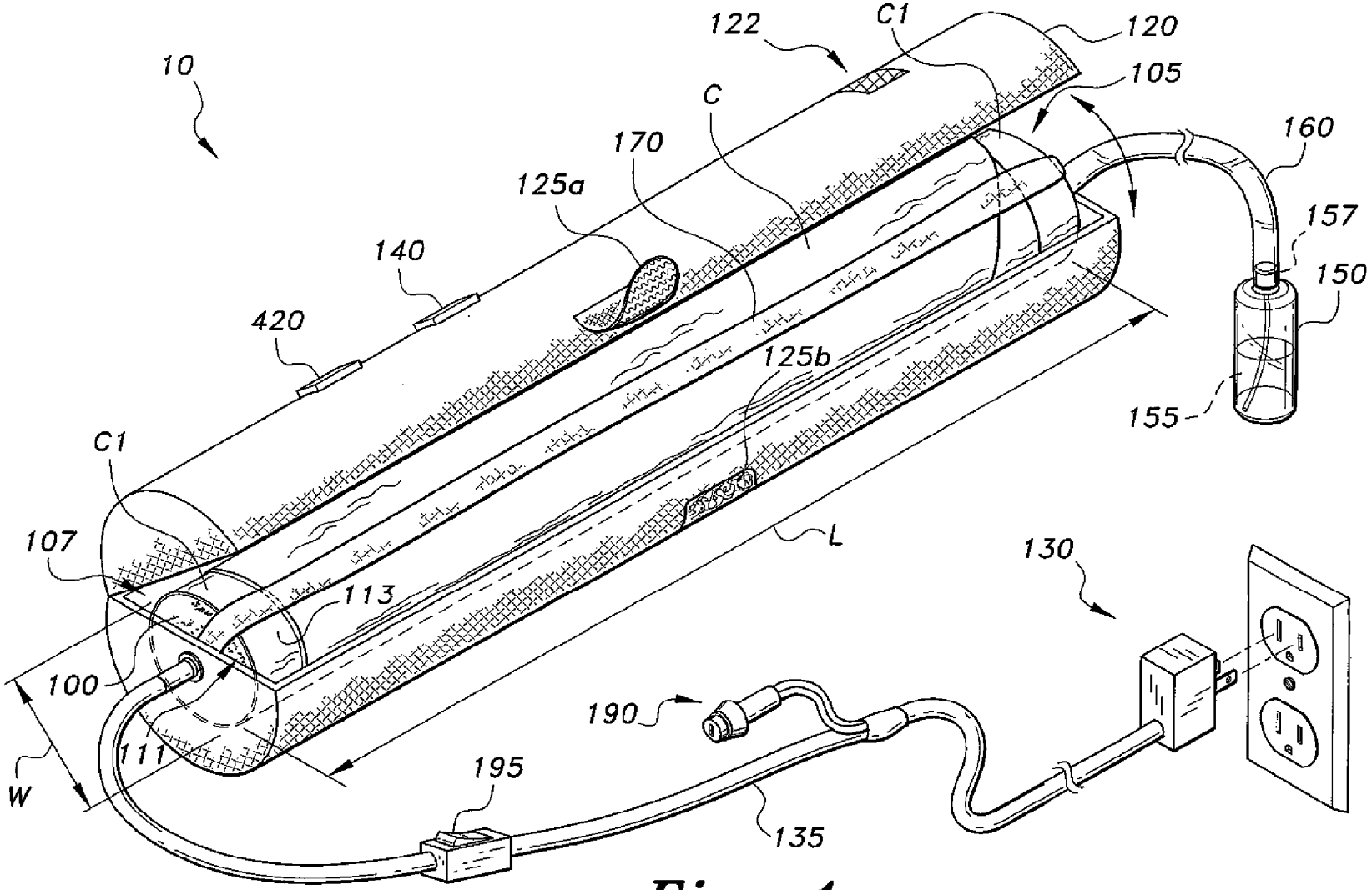
FIG. 1 is an environmental, perspective view of a machine for removing wrinkles from fabric according to the present invention.

Referring to FIGS. 1-4, the machine for removing wrinkles from fabric, designated generally as 10 in the drawings, includes a tubular member 100, a rod 110 positioned inside the tubular member 100 to support the tubular member 100 inside a case 120 (FIGS. 2A and 2B), and a heating element 200 positioned in communicating relation with the tubular member 100, the heating element 200 being configured to receive power from a power source, such as a 12-Volt car cigarette lighter, a wall plug 130 for a typical 120-Volt outlet, or other suitable power source. The case 120 may have a selectively closable fastener, such as mating hook and loop fasteners 125*a*, 125*b*, at least one temperature sensor 410, a timer 140, and at least one fragrance canister 150 having a fragrance dispenser outlet 157 and a corresponding delivery tube 160. The fragrance dispenser 157 is configured for dispensing a fragrance 155 onto a piece of fabric, such as clothing C.

The tubular member 100, which may be a tubular sponge member having a first end 105, a second end 107, an inner portion 111, and an outer portion 113, can be made from any suitable fire-resistant material, such as Nomex®. Further, the material of the tubular member 100 can be designed and/or treated with chemicals to enable the tubular member 100 to be heated to high temperatures, e.g., up to 100° C., without combusting. The tubular member 100 can be configured to have a width W of about 7 cm and a length L of about 55 cm. However, the size of the tubular member 100 can be varied to accommodate different types of clothing C, as well as clothing C of different sizes. The tubular member 100 can include a cloth C1 to cover the outer portion 113 of the tubular member 100 and protect the clothing C from getting burned while the clothing C is being treated. Further, the tubular member 100 can include a strap 170 having an end coupled to the first end 105 of the tubular member 100 and another end removably coupled, such as with hook and loop or other suitable fastener means, to the second end 107 of the tubular member 100, the strap 170 being configured for securing the clothing C onto the outer portion 113 of the tubular member 100.

Referring to FIGS. 1, 2A, 2B, and 3, the rod 110 can be made from heat-resistant plastic, Teflon®, metal, or any suitable material having the ability to withstand high temperatures, e.g., up to 100° C. The heating element 200, such as a heating wire or filament, can be positioned in communicating relation with the rod 110, such as being wrapped around the rod 110, and can have a suitable length, such as a length of 20 m. It is also to be noted that the heating element 200 can be arranged in communicating relation with a plurality of heating panels. For example, two layers of Kapton® can be held together by a suitable bonding adhesive, such as Teflon bonding adhesive, that is encased by a resistance foil, which can allow for a high temperature. Each of the plurality of panels can have any suitable dimension, such as 10×5 cm, sufficient to fit inside the case 120.

Further, the heating element 200 can include a receiving member 109 for receiving a power cable 135 through which power can be transmitted from the power source, such as such as a 12-Volt car cigarette lighter, a typical 120-Volt outlet, or other suitable power source. The rod 110 having the heating element 200 can then be inserted into the inner portion 111 of the tubular member 100. It is important to note that the inner portion 111 of the tubular member 100 can include a protective covering 119, such as aluminum foil or other suitable material, to cover the inner portion 111 of the tubular member 100 and protect the tubular member 100 from catching fire or overheating. The heating element 200 can communicate with a fuse 190 configured for preventing an electrical current from exceeding a predetermined safe level. Further, the heating element 200 can communication with an "on/off" switch 195 configured for activating and deactivating the heating member 200.

The at least one fragrance canister 150 and the corresponding tube 160 can be made from heat-resistant plastic or other suitable heat-resistant material. The tube 160 can be positioned in communication with the tubular member 100, preferably positioned at an end, such as the first end 105, of the tubular member 100 opposite the heating member 200, which can be positioned at the second end 107 to avoid melting the tube 160 or causing electrical issues, such as a short circuit. The fragrance dispenser 157 can dispense the fragrance 155 onto the clothing C at a predetermined time, such as at a predetermined period in a treatment cycle. The fragrance dispenser 157 can be a spray or other suitable means so that the clothing C receives the necessary amount of fragrance 155 to attain the desired scent. The tube 160 and the associated fragrance canister 150 can be located in the case 120, such as in the lining of the case 120, to dispense the fragrance 155 on a specific portion of the clothing C or mix the fragrance with steam. It is to be noted that the fragrance 155 can also be dispersed manually after the wrinkles have been removed.

Figure 2A:
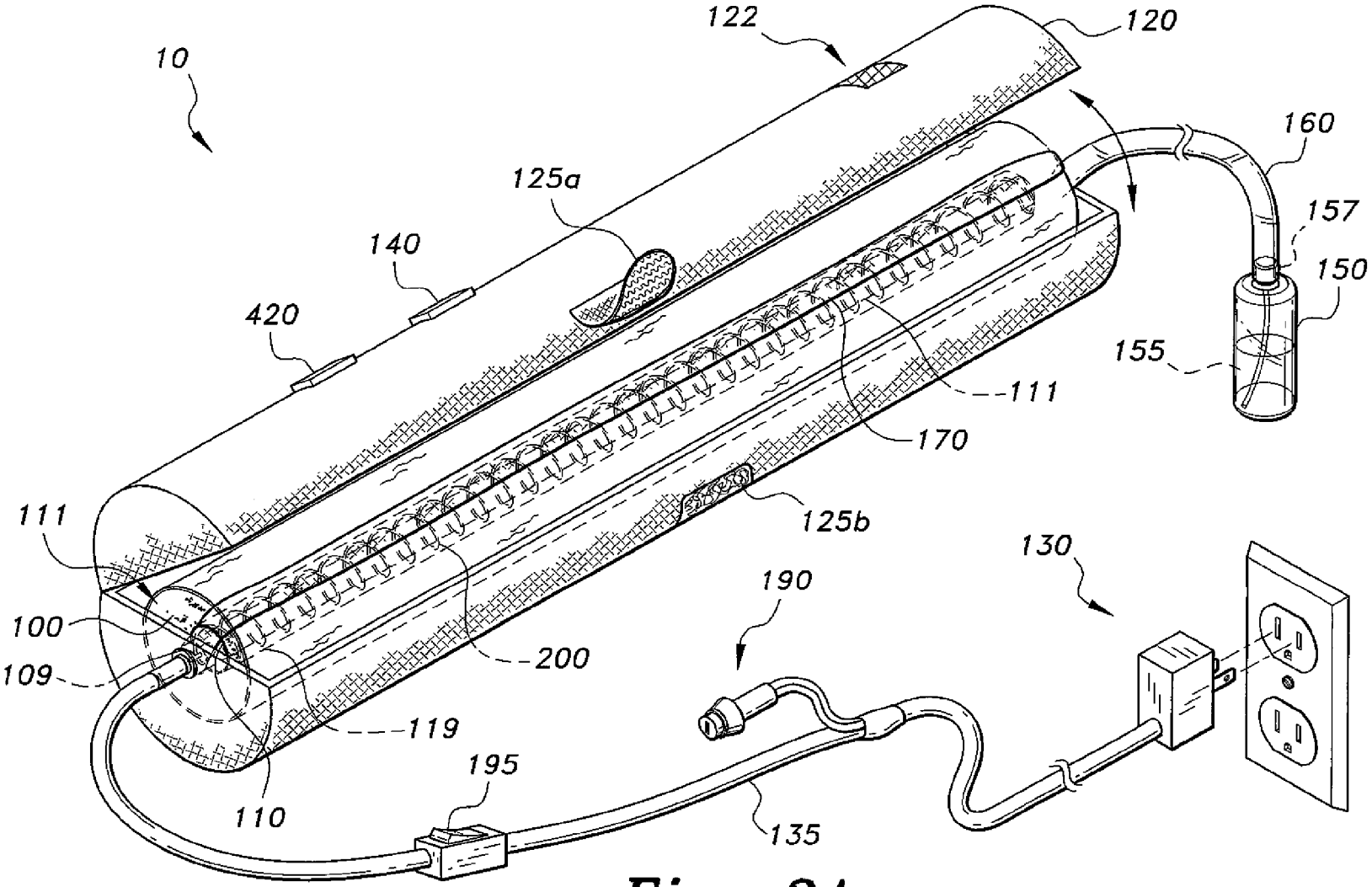
FIG. 2A is a perspective view of a machine for removing wrinkles from fabric according to the present invention, showing the heating element.
Figure 2B:
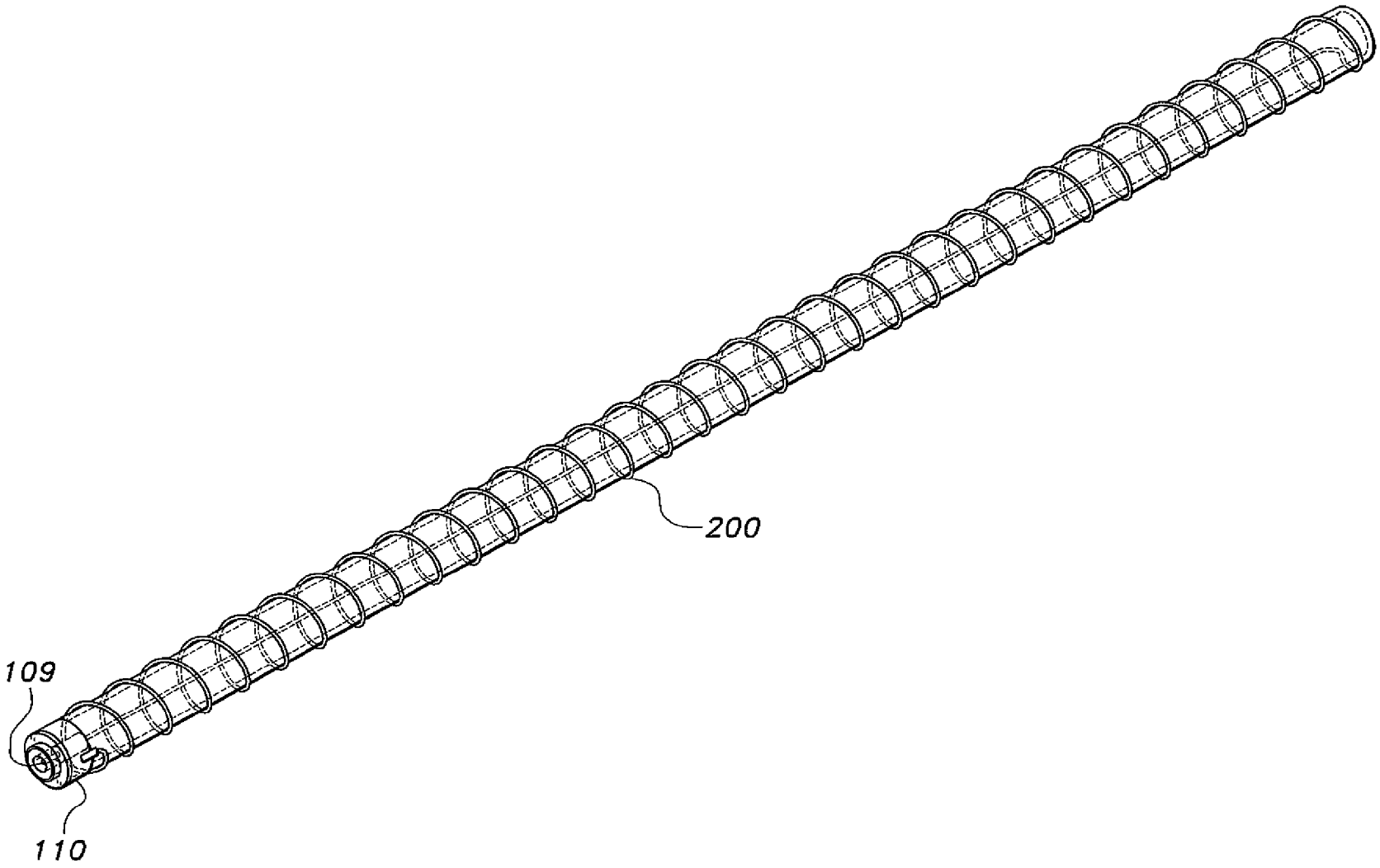
FIG. 2B is a perspective view of a heating element for a machine for removing wrinkles from fabric according to the present invention.
Figure 3:
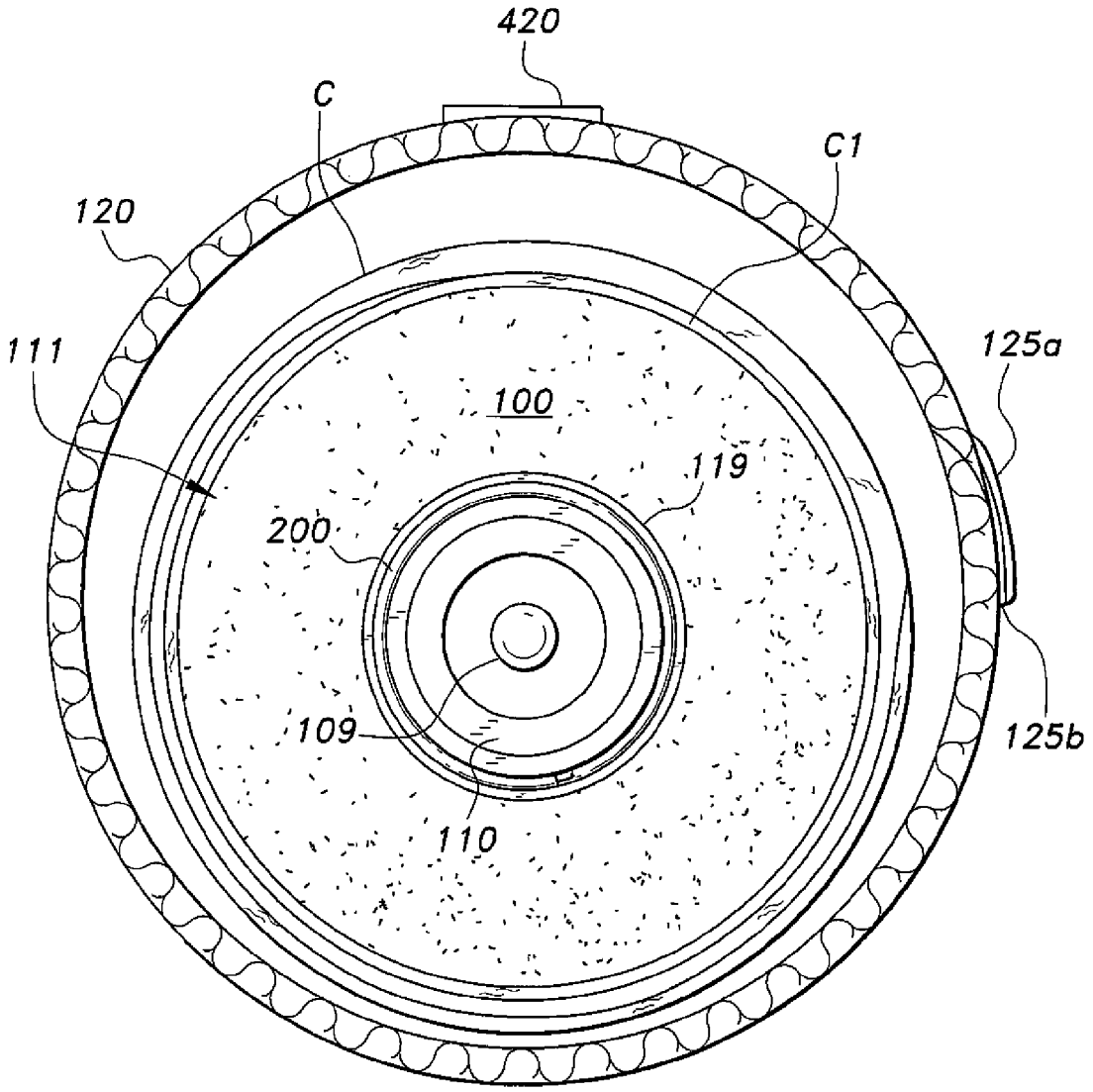
FIG. 3 is a transverse section view of a machine for removing wrinkles from fabric according to the present invention.

The case 120 can be made from leather or any suitable heat-resistant material that can retain the heat emitted by the heating element 200 to substantially remove the wrinkles from the clothing C. The case 120 can include at least one first opening 122 to vent any unnecessary heat and relieve any build-up of heat. Further, the case 120 can also be adapted to allow the heating element 200 to connect to the power source 130, as illustrated in FIGS. 1 and 2A.

Figure 4:
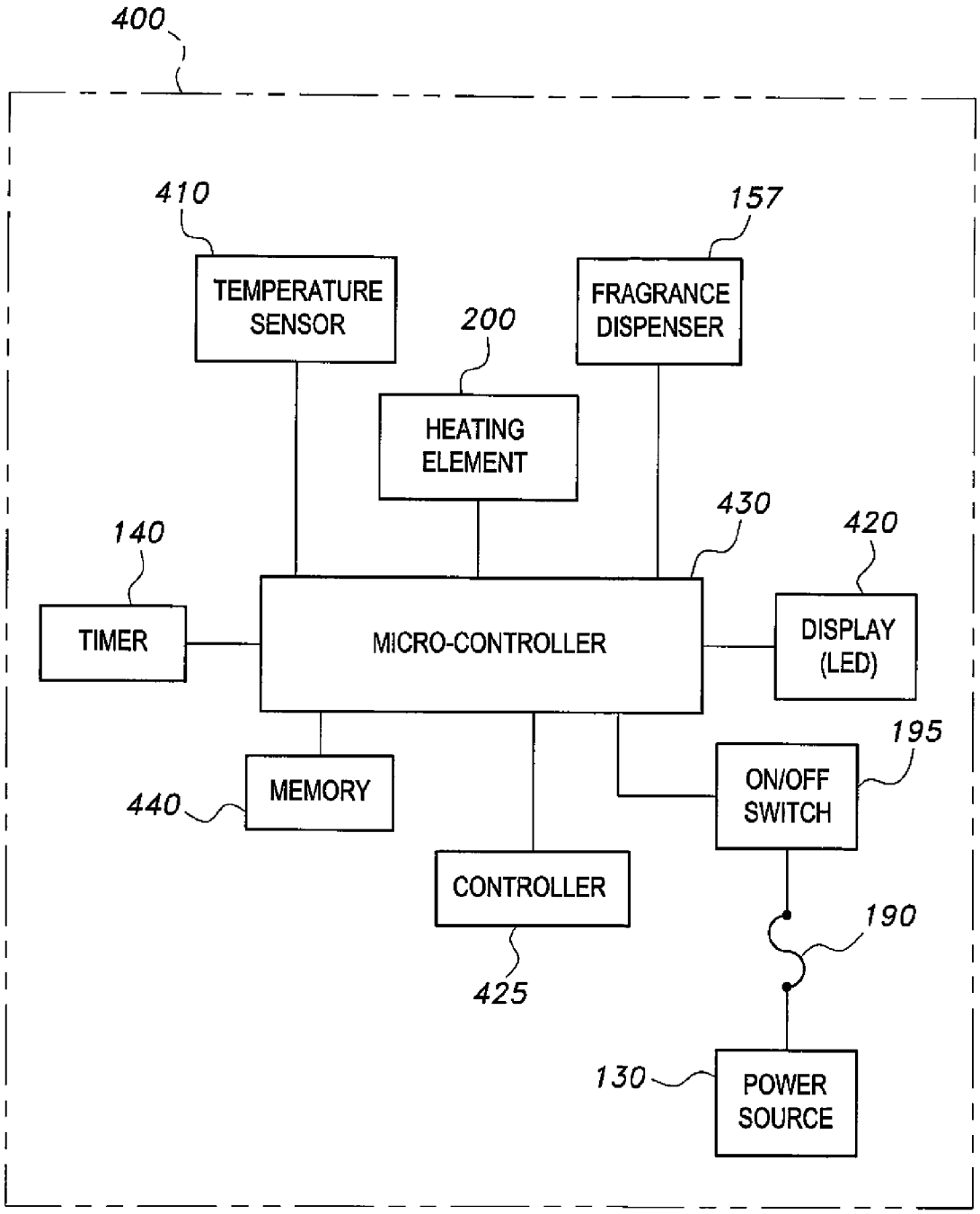
FIG. 4 is a block diagram of the electrical components of a machine for removing wrinkles from fabric according to the present invention.

FIG. 4 illustrates a generalized system 400 for implementing the electrical components of the machine 10. The generalized system 400 includes a controller 425, the on/off switch 195 in communication at least one micro-controller 430 and a display 420, the micro-controller 430 being in association with a memory 440, the heating element 200, the at least one temperature sensor 410, the timer 420, and the at least one fragrance dispenser 157. It should be noted that the micro-controller 430 can be positioned inside the case 120, such as inside the lining of the case 120 or in another suitable location from which the micro-controller 430 can communicate with the other components of the machine 10, including the on/off switch 195, the at least one temperature sensor 410, the display 420, the controller 425, the timer 140, the heating element 200, and the at least one fragrance dispenser 157. It is to be noted that the power source 130 used to provide power to the heating element 200 can also be used to provide power to the generalized system or the generalized system 400 can be configured to include a separate power source, such as a battery.

The generalized system 400 can represent a controller or a networked portable device, for example. Data for or information related to instructions for removing wrinkles, such as the type of fabric, the temperature, and the length of time can be acquired by or provided by a user or from another source via any suitable type of user interface, such as the controller 425 and/or the timer 140, and can be stored in the memory 440, such as computer readable memory, which can be any suitable type of computer readable and programmable memory. Calculations, decisions or determinations can be performed or implemented by the microcontroller 430, which can be any suitable type of microcontoller, and can be displayed to the user of the machine 10 on the display 420, which can be any suitable type of computer display or other suitable display, such a Light Emitting Diode (LED) or liquid crystal display (LCD).

Examples of computer readable media as can be used or included in the memory 440 can include a non-transitory computer readable storage memory, a magnetic recording apparatus, an optical disk, a magneto-optical disk, and/or a semiconductor memory (for example NOR, OTP, RAM, ROM, etc.). Examples of magnetic recording apparatus that can be used in addition to the memory 440 or in place of the memory 440, include a hard disk (HDD), a flexible disk (FD), and a magnetic tape (MT). Example of the optical disk include a DVD (Digital Versatile Disc), a DVD-RAM, a CD-ROM (Compact Disc-Read Only Memory), and a CD-R (Recordable)/RW.

The at least one temperature sensor 410 can be a precision integrated-circuit having an output voltage linearly proportional to the Centigrade temperature. This can be an advantage over other linear temperature sensors calibrated in degrees Kelvin, since a user is not required to subtract a large constant voltage from the output to obtain the Centigrade scaling. Further, the at least one temperature sensor 410 will typically not require any external calibration or trimming to provide an accurate temperature within a range of about +¼° C. to −¼ ° C. at room temperature. The at least one temperature sensor 410 can also provide an accurate temperature within a range of about +¾° C. to −¾° C. when the ambient temperature ranges from −55° C. to +150° C. The linear output and precise calibration of the at least one temperature sensor 410 can make interfacing the at least one temperature sensor 410 and the display 420 relatively simple.

Further, the at least one temperature sensor 410 can also be used in conjunction with a single power source, since the at least one temperature sensor 410 will typically only draw about 60 milliamps (mA) from the power source 130. As such, the at least one temperature sensor 410 may have a low self-heating of less than about 0.1° C. in still air. The at least one temperature sensor 410 can be configured to prevent the heating member 200 from over-heating. For example, the at least one temperature sensor 410 can be adapted to communicate with the microcontroller 430 to deactivate the heating element 200 if a temperature greater than the predetermined temperature for a particular type of fabric is reached. It is to be noted that the generalized system 400 can also include the fuse 190 to prevent the machine 10 from catching fire.

The microcontroller 430 can be associated with, or incorporated into, any suitable type of computing device, such as a peripheral interface controller (PIC) or an application specific integrated circuit (ASIC). The "on/off" switch 195, the display 420, the controller 425, the microcontroller 430, the memory 440, and any associated computer readable media can be in communication with one another by any suitable type of data bus, as is well known in the art, for example.

By way of operation, the rod 110 having the heating element 200, e.g., a heating element 200 wrapped around the rod 110, is inserted into the inner portion 111 of the tubular member 100, as illustrated in FIG. 2A. The clothing C is then laid flat onto a table or another suitable structure where it can be rolled onto or around the outer portion 113 of the tubular member 100. It is to be noted that the clothing C can be dry, damp, moist, or wet at the time that it is rolled onto the outer portion 113 of the tubular member 100. Whether the clothing C is dry, damp, moist, or wet will typically depend on the treatment instructions for the particular type of clothing C. The fastener 170 can then be secured, such as by hook and loop or other suitable means, to the second end 107 of the tubular member 100 to secure the clothing C to the tubular member 100.

The tubular member 100 having the clothing C is then inserted into the case 120. Once the case 120 has been closed and the locking mechanism 125*a*, 125*b* locked, the heating element 200 can be coupled to the power source 130. The "on/off" switch 195 can then be turned to the "on" position so that the heating element 200 can reach a certain temperature, such as a predefined temperature, in accordance with the treatment instructions for a particular piece of Clothing C. Further, the timer 140 can also be set for a certain amount of time, such as between three (3) to five (5) minutes, in accordance with the treatment instructions for the particular piece of clothing C, such as silk, wool, cotton, etc. In addition to the temperature and the time, it is also noted that at the time the "on/off" switch 195 is turned to the "on" position, the user can also select whether perfume will be dispensed onto the clothing C and whether the clothing C will be sterilized.

For example, if the clothing C is moist, damp, or wet at the time it is rolled onto the outer portion 113 of the tubular member 100, the heating element 200 can be set to reach a certain temperature, at which point the heat can cause the water or other liquid on the clothing C to evaporate and create steam to remove or substantially remove the wrinkles from the clothing C contained in the machine 10. Further, as discussed above, the type of clothing C being treated will determine the amount of time that the clothing C is kept inside the machine 10. For example, a pair of jeans may require more time in the machine 10 to remove wrinkles than a cotton shirt. After the clothing C has been treated for the requisite amount of time, the clothing C can be removed the machine 10 and can be ready to wear.

It is to be understood that the present invention is not limited to the embodiments described above, but encompasses any and all embodiments within the scope of the following claims.

I claim:

1. A machine for removing wrinkles from fabric, the machine comprising:

a tubular member having a first end, a second end, an inner portion, and an outer portion, wherein the tubular member comprises a tubular sponge member;

a rod supporting the tubular member, the rod positioned in the inner portion of the tubular member;

a heating element positioned in communicating relation with the rod; and a case enclosing the tubular member.

2. The machine for removing wrinkles from fabric according to claim 1, further comprising at least one temperature sensor configured to detect the temperature inside the case, the temperature sensor being mounted on the case.

3. The machine for removing wrinkles from fabric according to claim 1, further comprising at least one fragrance canister having a fragrance dispenser configured for dispersing a fragrance onto a piece of fabric, the canister being connected to the case.

4. The machine for removing wrinkles from fabric according to claim 3, wherein the fragrance dispenser comprises a spray.

5. The machine for removing wrinkles from fabric according to claim 1, further comprising a timer mounted on the case.

6. The machine for removing wrinkles from fabric according to claim 1, wherein the tubular member includes a strap attached thereto for securing a piece of clothing to the tubular member.

7. The machine for removing wrinkles from fabric according to claim 1, wherein the tubular member has a width of about 7 cm and a length of about 55 cm.

8. The machine for removing wrinkles from fabric according to claim 1, wherein the heating element has a power cable adapted for attachment to a 12-volt car cigarette lighter outlet.

9. A machine for removing wrinkles from fabric, the machine comprising:

a tubular member having a first end, a second end, an inner portion, and an outer portion;

a rod supporting the tubular member, the rod positioned in the inner portion of the tubular member;

a heating element positioned in communicating relation with the rod;

a case enclosing the tubular member; and at least one fragrance canister having a fragrance dispenser configured for dispersing a fragrance onto a piece of fabric, the canister being connected to the case.

10. The machine for removing wrinkles from fabric according to claim 9, further comprising at least one temperature sensor configured to detect the temperature inside the case, the sensor being attached to the case.

11. The machine for removing wrinkles from fabric according to claim 9, wherein the fragrance dispenser comprises a spray.

12. The machine for removing wrinkles from fabric according to claim 9, further comprising a timer attached to the case.

13. The machine for removing wrinkles from fabric according to claim 9, wherein the tubular member includes a strap attached thereto adapted to secure the piece of clothing to the tubular member.

14. The machine for removing wrinkles from fabric according to claim 9, wherein the tubular member has a width of about 7 cm and a length of about 55 cm.

15. The machine for removing wrinkles from fabric according to claim 9, wherein the case includes a fastener.

* * * * *